United States Patent [19]

Fanelli et al.

[11] Patent Number: 4,787,989

[45] Date of Patent: Nov. 29, 1988

[54] ANIONIC SOIL RELEASE COMPOSITIONS

[75] Inventors: Joseph J. Fanelli, Alpharetta; Randy L. Rayborn, Winder; Donald Jenkins, Duluth; Anthony J. O'Lenick, Jr., Lilburn, all of Ga.

[73] Assignee: GAF Corporation, Wayne, N.J.

[21] Appl. No.: 143,581

[22] Filed: Jan. 13, 1988

[51] Int. Cl.[4] ..... D06M 00/00; C11D 3/37; C11D 1/00

[52] U.S. Cl. ..... 252/8.6; 252/807; 252/8.9; 252/174.19; 252/174.25; 252/DIG. 15; 252/174.23; 528/272; 528/274; 528/296; 528/339

[58] Field of Search ..... 252/8.6, 8.7, 8.9, 174.19, 252/174.25, DIG. 15; 528/272, 274, 296, 339

[56] References Cited

U.S. PATENT DOCUMENTS

| | | | |
|---|---|---|---|
| 3,959,230 | 5/1976 | Hays | 252/8.9 |
| 4,125,370 | 11/1978 | Nizol | 252/8.9 |
| 4,225,646 | 9/1980 | Cushion, Jr. | 252/8.9 |
| 4,233,436 | 11/1980 | Robinson | 528/366 |
| 4,257,928 | 3/1981 | Vachon et al. | 524/386 |
| 4,268,645 | 5/1981 | Lark | 525/437 |
| 4,611,021 | 9/1986 | Zamek | 524/317 |
| 4,711,730 | 12/1987 | Goselink et al. | 252/8.75 |

*Primary Examiner*—Robert Wax
*Assistant Examiner*—Ronald A. Krasnow
*Attorney, Agent, or Firm*—Marilyn J. Maue; Joshua J. Ward

[57] ABSTRACT

The present invention relates to a class of compounds which have superior soil release properties over heretofore known soil release polymers. The compounds are prepared by the reaction of an aromatic hydroxy containing polyester soil release agent with trimellitic anhydride under acid catalysis to produce an aromatic terminal capped carbonyloxy soil release polymer.

12 Claims, No Drawings

ANIONIC SOIL RELEASE COMPOSITIONS

BACKGROUND OF THE INVENTION

The present application relates to anionic block polyesters useful as soil release and antistatic agents. In addition to cleaning performance, laundry detergent compositions should have other benefits. One is the ability to impart soil release properties to fabrics woven from polyester and other fibers. These fabrics are predominantly co-polymers of ethylene glycol and terephthalic acid, and are sold under a number of trade names, e.g., Dacron, Fortrel, Kodel and Blue C Polyester. The hydrophobic character of polyester fabrics makes their laundering difficult, particularly with oily soil and oily stains. The oily soil or stain preferentially "wets" the fabric. As a result, the oily soil or stain is difficult to remove in an aqueous laundering process.

Products which have been used for their soil release and antistatic agents properties can be divided into several classes based upon the chemistry of the products.

Polyesters containing random ethylene terephthalate/polyethylene glycol (PEG) terephthalate units High molecular weight (e.g., 40,000 to 50,000 M.W.) polyesters containing random ethylene terephthalate/-polyethylene glycol (PEG) terephthalate units have been used as soil release compounds in laundry detergent compositions. U.S. Pat. No. 3,962,152 to Nicol et al, issued June 8, 1976. During the laundering operation, these soil release polyesters adsorb onto the surface of fabrics immersed in the wash solution. The adsorbed polyester then forms a hydrophilic film which remains on the fabric after it is removed from the wash solution and dried. This film can be renewed by subsequent washing of the fabric with a detergent composition containing the soil release polyesters.

These ethylene terephthalate/PEG terephthalate polyesters are not water-soluble. It is believed that they form a suspension in the wash solution which does not adsorb efficiently onto the fabrics. As a result, the level of soil release polyester in the detergent composition has to be increased if benefits are to be obtained after several wash cycles. Because of this poor water-solubility, these polyesters are formulated as suspensions in laundry detergent compositions, rather than as isotropic liquids. In certain detergent formulations, these polyesters can also diminish clay soil cleaning performance.

Polyester antistatic agents formed from dimethyl terephthalate, ethylene glycol and methoxy PEGs U.S. Pat. No. 3,416,952 to McIntyre et al., issued Dec. 17, 1968, discloses the treatment of shaped polyester articles with a water-insoluble crystallizable polymeric compound which can contain a water soluble polymeric group such as a polyoxyalkylene group having an average molecular weight of from 300–6000. Preferred polyoxyalkylene groups are the PEGs having an average molecular weight of from 1000–4000. Treatment of the shaped articles is carried out by applying an aqueous dispersion of the crystallizable polymeric compound in the presence of an anti-oxidant, followed by heating to a temperature above 90 degrees C. to obtain a durable coating of the compound on the shaped article. One such crystallizable polymeric compound is formed by the reaction of dimethyl terephthalate, ethylene glycol and an O-methyl poly-(oxyethylene) glycol of average molecular weight 350. A 20% solution of this polyester in benzyl alcohol was used to impart antistatic properties to a polyester fabric. The patent also discloses a 20% aqueous solution of a similar polyester used to impart antistatic properties to a polyester fabric.

Polyester antistatic and soil release agents formed from dimethyl terephthalate, sodium dimethyl-5-sulphoisophthalate, ethylene glycol and polyethylene glycol (PEG)

U.S. Pat. No. 4,427,557 to Stockburger, Jan. 24, 1984, discloses low molecular weight copolyesters (M.W. 2,000 to 10,000) which can be used in aqueous dispersions to impart soil release properties to polyester fibers. The copolyesters are formed by the reaction of ethylene glycol, a PEG having an average molecular weight of 200 to 1000, an aromatic dicarboxylic acid (e.g., dimethyl terephthalate), and a sulfonated aromatic dicarboxylic acid (e.g., dimethyl 5-sulfoisophthalate). The PEG can be replaced in part with monoalkylethers of PEG such as the methyl, ethyl and butyl ethers. A dispersion or solution of the copolyester is applied to the textile material and then heat set at elevated temperatures (90 degrees to 150 degrees C.) to impart durable soil release properties.

Monomeric polyesters of PEG and terephthalic acid useful as soil release agents U.S. Pat. No. 4,349,688 to Sandler, issued Sept. 14, 1982, discloses polyoxyalkylene phthalate ester soil release agents.

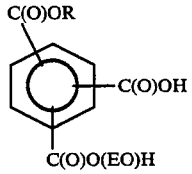

Durable soil resistance and water wicking properties are imparted by wetting the fabric with a composition containing the polyoxyalkylene ester, drying the wetted fabric, and then curing the dried fabric at a temperature of from 190–200 degrees C. for about 45–90 seconds.

Ethylene terephthalate/PEG terephthalate soil release polyesters for fabric treating solutions U.S. Pat. No. 3,959,230 to Hays, issued May 25, 1976, discloses polyester soil release agents containing random ethylene terephthalate/PEG terephthalate units in a mole ratio of from about 25:75 to about 35:65. These soil release polyesters have a molecular weight of from about 25,000 to about 55,000, (preferably from about 40,000 to about 55,000) and are used in dilute, aqueous solutions, preferably with an emulsifying agent present. Fabrics are immersed in this solution so that the soil release polyester adsorbs onto the fabric surface. The polyester forms a hydrophilic film which remains on the fibers after the fabric is removed from the solution and dried. See also U.S. Pat. No. 3,893,929 to Basadur, issued July 8, 1975 (compositions for imparting soil release finish containing a polyester having an average molecular weight of 3000–5000 formed from terephthalic acid, PEG and ethylene glycol); U.S. Pat. No.

3,712,873 to Zenk, issued Jan. 23, 1973 (textile treating composition comprising fatty alcohol polyethoxylates; quaternary ammonium compounds; a polyester having average molecular weight of 3000–5000 formed from terephthalic acid, PEG and ethylene glycol; and starch).

Ethylene terephthalate/PEG terephthalate soil release agents used in detergent compositions U.S. Pat. No. 3,962,152 to Nicol et al., issued June 8, 1976, discloses detergent compositions containing detergent surfactants and the ethylene terephthalate/PEG terephthalate soil release polyesters disclosed in U.S. Pat. No. 3,959,230 issued to Hays. Additionally U.S. Pat. No. 4,116,885 to Derstadt et al., issued Sept. 26, 1978 (detergent compositions containing certain compatible anionic detergent surfactants and ethylene terephthalic/PEG terephthalate soil release polyesters); U.S. Pat. No. 4,132,680 to Nicol, issued Jan. 2, 1979 (detergent compositions containing detergent surfactants; a composition which disassociates to yield quaternary ammonium cations; and an ethylene terephthalate/PEG terephthalate soil release polyester) are of interest.

Soil release and antistatic polyurethanes useful in detergent compositions which contain polyester blocks having sulfoisophthalate units U.S. Pat. No. 4,201,824 to Violland et al., issued May 6, 1980, discloses hydrophilic polyurethanes having soil release and antistatic properties useful in detergent compositions. These polyurethanes are formed from the reaction product of a base polyester with an isocyanate prepolymer (reaction product of diisocyanate and macrodiol). Further, a disclosure of base polyester formed from dimethyl terephthalate, dimethyl sulfoisophthalate, ethylene glycol and PEG (molecular weight 300) which is reacted with a prepolymer formed from a PEG (molecular weight 1,500) and toluene diisocyanate is made.

The previously mentioned patents, included by reference, describe a number of ways that one can make polymeric materials which are substantive to fiber. This substantivity renders the fiber soil resistant.

One shortcoming of these polyester type polymers used as soil release materials is that the benefits of softening and hand modification desired by the consumer are not realized. Softeners are typically formulated into detergents or added in a post step as a rinse cycle softener.

Additionally, U.S. Pat. No. 4,134,839 to Marshall discloses the use of an alkanolamide reacted with a polycarboxybenzene ester to give a soil release polymer.

U.S. Pat. No. 4,375,540 to Joyner discloses copolyester derivatives from aromatic dibasic acid and aliphatic dibasic acids of glycol.

U.S. Pat. No. 4,310,426 to Smitz discloses a yellowing resistant soil release agent.

U.S. Pat. No. 4,094,796 to Schwarz discloses a novel polyoxyalkylene polymeric.

THE INVENTION

It is the objective of this invention to provide both soil release and antistatic properties. More specifically, the present invention is directed to certain polyoxyalkylene ester carboxylates and the preparation and application of said polyoxyalkylene ester carboxylates. The presence of a terminal carbonyloxy group improves the soil release properties over more conventional soil release agents. The terminal position and the carbonyloxy nature are very important to the functionality of the molecule. We have determined that the choice of catalyst used in the reaction can have a profound effect upon where the hydroxyl group reacts. This in turn has a dramatic effect upon hydrolytic stability and performance.

Trimellitic anhydride has the following structure;

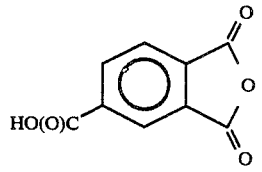

We have discovered that when an acidic catalyst like paratoluene sulfonic acid is used, the anhydride functionality is maintained and reaction occurs at the carboxyl group in the 5 position of the aromatic ring. The fact that water is distilled off under reaction conditions confirms that the anhydride did not react. If the anhydride had in fact opened there would be no distillate. Additionally, the presence of the anhydride is confirmed by Infra Red analysis 1780 $cm^{-1}$ and wet analysis.

Percentages and ratios used herein are by weight, unless otherwise noted. References cited herein are incorporated by reference.

DETAILED DESCRIPTION OF THE INVENTION

The compounds of the invention conform to the following generic structure;

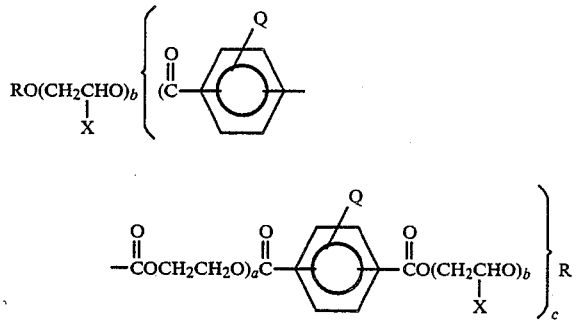

R″ is

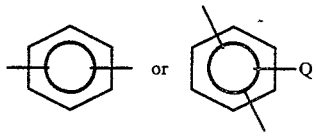

Q is H or $SO_3Na$; X is H or $CH_3$ a is an integer from 1–5; b is an integer from 1–200 preferably from 1–20 c is an integer from 1–50 preferably from 1–10; M is Na, H, K, Li, $NH_4$

The compounds of this invention can be formulated into products that are applied directly in aqueous solution by themselves or formulated with anionics or nonionics and builders to prepare finished conditioner/detergent systems. The following data demonstrates that the compounds of the present invention provide desirable properties when compared to commercially available products. Rating System 1 is worst 5 is best. Soil Release was tested on polyester fabrics using AATCC Method 130. These tests are used to evaluate the ability of a compound to release oily soils during home laundering. Values 2 and below are considered non performing.

| | (Average of 3 tests) | | | |
|---|---|---|---|---|
| | Soil Release | | | Relative |
| | 0 Wash | 5 Wash | Relative Wicking | Hand |
| | Standard Soil Release Agents* | | | |
| Example | | | | |
| 1 | 4.8 | 4.0 | 1 | 1 |
| 2 | 5.0 | 1.0 | 3 | 3 |
| 3 | 4.0 | 1.0 | 2 | 2 |
| 4 | 4.0 | 1.0 | 3 | 3 |
| Compounds of this Invention | | | | |
| 5 | 5.0 | 4.2 | 4 | 5 |
| 6 | 4.5 | 3.9 | 3 | 3 |
| 7 | 4.8 | 3.0 | 3 | 4 |
| 8 | 4.5 | 4.0 | 3 | 3 |

*the soil release agent can be any anionic or non-ionic surfactant
(1) Ratings: 5 = best, 1 = worst
Fabric = 100% polyester knit The raw materials used to prepare the compounds of the invention include but are not limited to Milease T, Alkaril QC-J (CAS # 9016-88-0) and Milease HPA (CAS # 8852-78-6). These materials conform to the following generic formulae;

1.

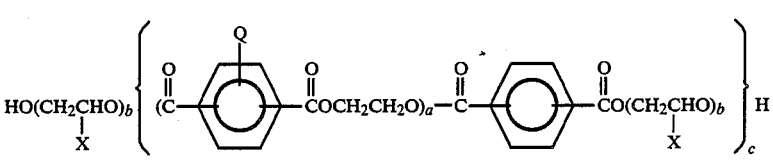

wherein
Q is hydrogen
X is H
a is an integer from 1–5
b is an integer from 1–200
c is an integer from 1–50

2.

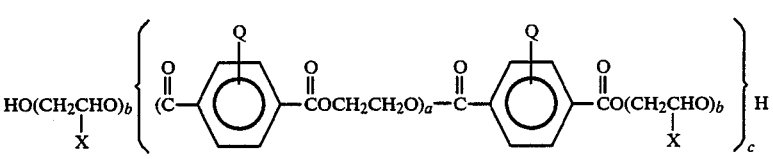

wherein
Q is a mixture of hydrogen and $SO_3Na$
X is H and/or $CH_3$
a is an integer from 1–5
b is an integer from 1–200
c is an integer from 1–50

3.

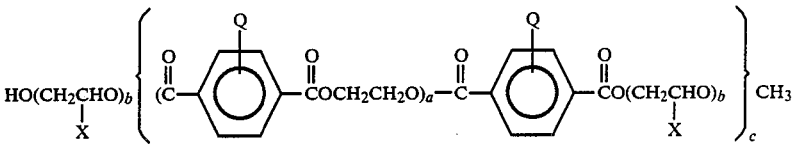

wherein
Q is a mixture of hydrogen and $SO_3Na$
X is H and/or $CH_3$
a is an integer from 1–5
b is an integer from 1–200
c is an integer from 1–50

SUITABLE PREPARATIONS FOR STARTING MATERIALS

The following processes, A–D illustrate methods for the preparation of starting materials used in this invention is as follows:

A

U.S. Pat. No. 3,557,039 teaches that dimethyl terephthalate (53.7 parts) dimethyl sodium sulfoisophthalate (9.1 parts) ethylene glycol (43 parts) calcium acetate hemihydrate (0.049 parts) and antimony trioxide (0.025 parts) were mixed together and heated until the theoretical amount of methanol is removed. Phosphorous acid is added (0.09 parts) and the excess glycol distilled off under vacuum at 282 degrees C.

B

U.K. Pat. No. 1,317,278 teaches spinning grade poly(ethylene terephthalate)(134.4 parts), polyethylene glycol of nominal molecular weight 1540 (308 parts) and antimony trioxide (0.0022 part) were charged to a 4-necked flask with a scaled bottom runoff tube and fitted with a stirrer, internal thermometer, nitrogen inlet and a condenser set for distillation. The flask was heated in an electric mantle through which the bottom runoff tube protruded. The temperature of the contents of the flask was raised to 260 degrees plus/minus 5 degrees C. over half an hour and held at 260 degrees C. plus/minus C. for three hours.

Additionally products containing both EO and PO can be made by substituting an ethylene oxide/propylene oxide polymer of the same molecular weight for the polyoxyethylene material above.

C 30.0 parts of dimethyl terephthalate, 10.0 parts of ethylene glycol along with 170 parts of polyethylene glycol of nominal molecular weight 4000 and antimony trioxide (0.0022 parts) were charged to a 4-necked flask with a scaled bottom runoff tube and fitted with a stirrer, internal thermometer, nitrogen inlet and a condenser set for distillation. The flask was heated in an electric mantle through which the bottom runoff tube protruded. The temperature of the contents of the flask was raised to 260 degrees plus/minus 5 degrees C. over half an hour and held at 260 degrees C. plus/minus C. for three hours.

Additionally products containing both EO and PO can be made by substituting an ethylene oxide/propylene oxide polymer of the same molecular weight for the polyoxyethylene material above.

D

Spinning grade poly-(ethylene terephthalate) (134.4 parts) a block polymer (2:1 ethylene oxide to propylene oxide having a molecular weight of 1540 MWU) (308 parts) and antimony trioxide (0.0022 part) were charged to a 4-necked flask with a scaled bottom runoff tube and fitted with a stirrer, internal thermometer, nitrogen inlet and a condenser set for distillation. The flask was heated in an electric mantle through which the bottom runoff tube protruded. The temperature of the contents of the flask was raised to 260 degrees plus/minus 5 degrees C. over half an hour and held at 260 degrees C. plus/minus 5 C.

EXAMPLES

General Procedure

Into a suitable reaction flask, equipped with a thermometer, nitrogen sparge and agitator is added the specified amount of raw material polymer (selected from examples 1–3). The raw material polymer is heated to 100 degrees C., under a nitrogen sparge. The specified amount of para toluene sulfonic acid is then added. Next, the specified amount of trimellitic anhydride is then added over a fifteen minute period under good agitation. Heat to 200 C. and hold for 6 to 10 hours.

| Example Number | Raw Material Method | Polymer Weight in Grams | p-Toluene Sulfonic Acid Weight in Grams | Tri mellitic Anhydride Weight in Grams |
|---|---|---|---|---|
| 1 | B | 875.0 | 2.0 | 123.0 |
| 2 | C | 920.0 | 2.0 | 78.0 |
| 3 | A | 953.0 | 1.5 | 145.0 |
| 4 | D | 850.0 | 2.0 | 148.0 |

EXAMPLE #5

A aqueous solution containing 0.1 to 1.0% active of one of the novel compounds selected from the above examples (1 to 4) are applied to a cotton polyester blend or fiber by exhaustion or using conventional dip and nip technology. The novel compound acts as a lubricant for the processing of the fiber and a superior soil release agent.

EXAMPLE #6

A solution of 0.25–1.50% active of one of the compounds above is applied to a polyester blend by exhaustion or using conventional dip and nip technology. The material acts as a lubricant for the processing of the fiber and a non-yellowing softener.

What is claimed:

1. A detergent composition comprising a surfactant and an effective soil releasing amount of a compound having the formula

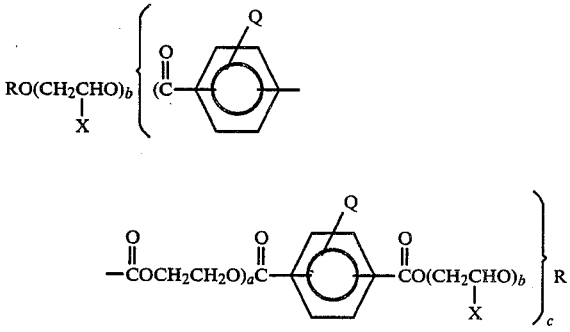

wherein

R is

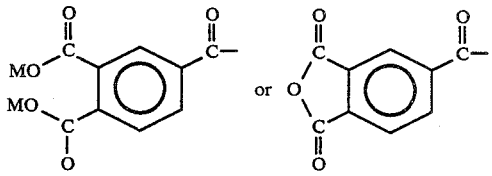

Q is selected from the group consisting of H and $SO_3Na$

X is H or $CH_3$ a is an integer from 1–5 b is an integer from 1–200 c is an integer from 1–50

M is selected from the group consisting of Na, H, K, Li and $NH_4$.

2. The composition of claim 1 wherein Q is H.

3. The composition of claim 1 wherein Q is $SO_3Na$.

4. The composition of claim 1 wherein X is $CH_3$.

5. The composition of claim 1 wherein X is H.

6. The composition of claim 1 wherein R is

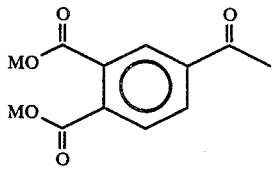

7. The composition of claim 1 wherein R is

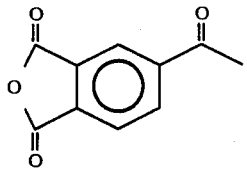

8. The composition of claim 1 wherein R is a blend of

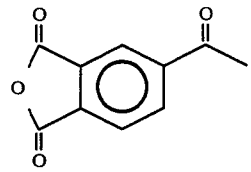

and

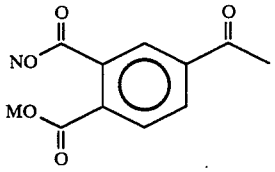

9. The composition of claim 1 wherein Q is a blend of hydrogen and $SO_3Na$.

10. The composition of claim 1 wherein b is an integer from 1–20 and c is an integer from 1–10.

11. A process for contacting a fibrous or keratinous with an effective soil releasing amount of the composition of claim 1.

12. The process of claim 11 wherein the substrate is polyester.

* * * * *